United States Patent [19]

Cerny

[11] 3,944,218

[45] Mar. 16, 1976

[54] SHEET TRANSFER CYLINDERS

[75] Inventor: Arnost Cerny, Blansko, Czechoslovakia

[73] Assignee: Adamovske strojirny, Prague, Czechoslovakia

[22] Filed: July 17, 1974

[21] Appl. No.: 489,364

Related U.S. Application Data

[63] Continuation of Ser. No. 273,356, July 20, 1972, abandoned.

[30] Foreign Application Priority Data

July 22, 1971 Czechoslovakia ..... 5389-71

[52] U.S. Cl. ..... 271/277; 101/230; 271/82

[51] Int. Cl.[2] ..... B65H 5/12

[58] Field of Search ..... 271/277, 82; 101/229, 230, 101/231, 183, 409, 410, 232; 74/568 R

[56] References Cited

UNITED STATES PATENTS

| | | | |
|---|---|---|---|
| 1,285,774 | 11/1918 | Middleditch | 101/409 |
| 2,699,115 | 1/1955 | Davidson | 101/232 |
| 2,757,610 | 8/1956 | Gegenheimer et al. | 101/230 X |
| 3,443,808 | 5/1969 | Siebke | 271/82 |
| 3,772,990 | 11/1973 | Weisgerber | 101/230 |

*Primary Examiner*—Evon C. Blunk
*Assistant Examiner*—Bruce H. Stoner, Jr.

[57] ABSTRACT

The present invention provides a sheet transfer cylinder for a rotary printing machine and has associated therewith a mechanism for gripping the sheets to be transferred and for turning same. The transfer cylinder is rotatably mounted in the side walls of the machine. One of the side walls is provided with a centering ring which is fixed relative to that side wall. The ring is provided with a pair of circular segments, one of which is adjustable circumferentially with respect to the ring. The transfer cylinder is provided with roller means which cooperate with the surfaces of said circular segments and which, in turn, cause the actuation of grippers carried by the transfer cylinder. Means are provided for regulating the degree of circumferential adjustment of the first of said circular segments.

4 Claims, 2 Drawing Figures

SHEET TRANSFER CYLINDERS

This is a continuation of application Ser. No. 273,356, filed July 20, 1972.

BACKGROUND OF INVENTION

The present invention relates to rotating printing machines and in particular to sheet transfer cylinders therefor, by which a paper sheet is seized on the cylinder, and turned over for printing on two sides.

A present technique for transferring paper sheets from one multicolor printing unit to the following printing unit is to use chains in which are mounted carrier rods provided with pairs of gripper members which seize the sheet. This mechanism for transferring sheets is simple and inexpensive, but it does not guarantee accurate registration for printing. A further disadvantage is the development of excessive noise at high printing speeds. When paper sheets are transferred by means of the chains and associated grippers it has been found necessary to utilize additional mechanisms in order to turn the sheets. Sheet transfer drums are frequently used for the transfer of the paper sheets to be printed. Such an arrangement provides satisfactory registration of the sheets even at high printing speeds. The transfer of the paper sheets by means of such transfer drums also enables the turning of the sheets for printing on both sides during a single passage through the printing machine. With this arrangement one of the sheet transfer drums or cylinders generally has a diameter twice the size of the other transfer cylinder, enabling a relative adjustment of the gripper sets on the respective transfer cylinders so that the grippers of one transfer cylinder delivers the paper sheet with its trailing edge into the grippers of the adjacent transfer cylinder.

It has heretofore been known to construct transfer cylinders with grippers which seize the leading edge of the paper sheet and to thereafter transfer the sheet with suction elements which are arranged on the surface of the cylinder adjacent to seize the trailing edge of the sheet. After such elements suck the paper sheet, the trailing edge of the sheet can be seized by the grippers of the following printing unit whereby the sheet is simultaneously transferred and turned so as to be ready for printing on the following unit.

The known mechanisms which enable conversion of the sheet transfer so that cylinder printing can be effected on either one or both sides are very complicated and expensive to produce. Due to the complexity of these mechanisms their accuracy in holding the paper sheet aligned during transfer is reduced and failure often occurs. The adjustment of such mechanisms by means of auxiliary control cams is time consuming, complicated, and the productivity of the printing machine is reduced.

Accordingly, an object of the present invention is the provision of a sheet transfer cylinder having a sheet gripper mechanism which can readily be adjusted for printing of the paper sheet on either one or both sides.

Another object of the invention is the provision of a sheet transfer cylinder having a gripping mechanism which is of relatively simple construction and performs reliably.

These objects, others and the advantages of the present invention will be seen from the following disclosure.

SUMMARY OF INVENTION

According to the present invention there is provided a sheet transfer cylinder for a rotary printing machine, having a cylinder on which is mounted a mechanism for gripping the sheets to be transferred and for turning the sheets. The cylinder is adapted to be rotatably mounted in side walls of the machine. One of the side walls is provided with a fixed centering ring coaxial with the axis of the transfer cylinder. The centering ring has a pair of circular segments secured to opposed peripheral faces thereof, the first of the segments being circumferentially adjustable with respect to the centering ring and the second of the segments being non-adjustable with respect to the centering ring. The sheet transfer is provided adjacent the surface thereof with a rotatable shaft adapted to carry the sheet gripping means secured rigidly thereto, and roller means carried at one end of the shaft adapted to engage with the outer surfaces of the first and second circular segments respectively. Rotation of the transfer cylinder results in movement of the rollers and actuation of the gripping means.

The mechanism of this invention requires only a simple manipulation to convert the printing machine from a capability for printing one side of the paper sheet to a capability for printing on both sides of the sheet, or vice-versa. While adjusting the machine, the suction elements are simultaneously adjusted in such a way that the distance between the suction elements and the grippers remain unchanged.

The invention is more fully described, by way of example, in the following description in which reference to the accompanying drawings is made.

DESCRIPTION OF INVENTION

Figure 1:
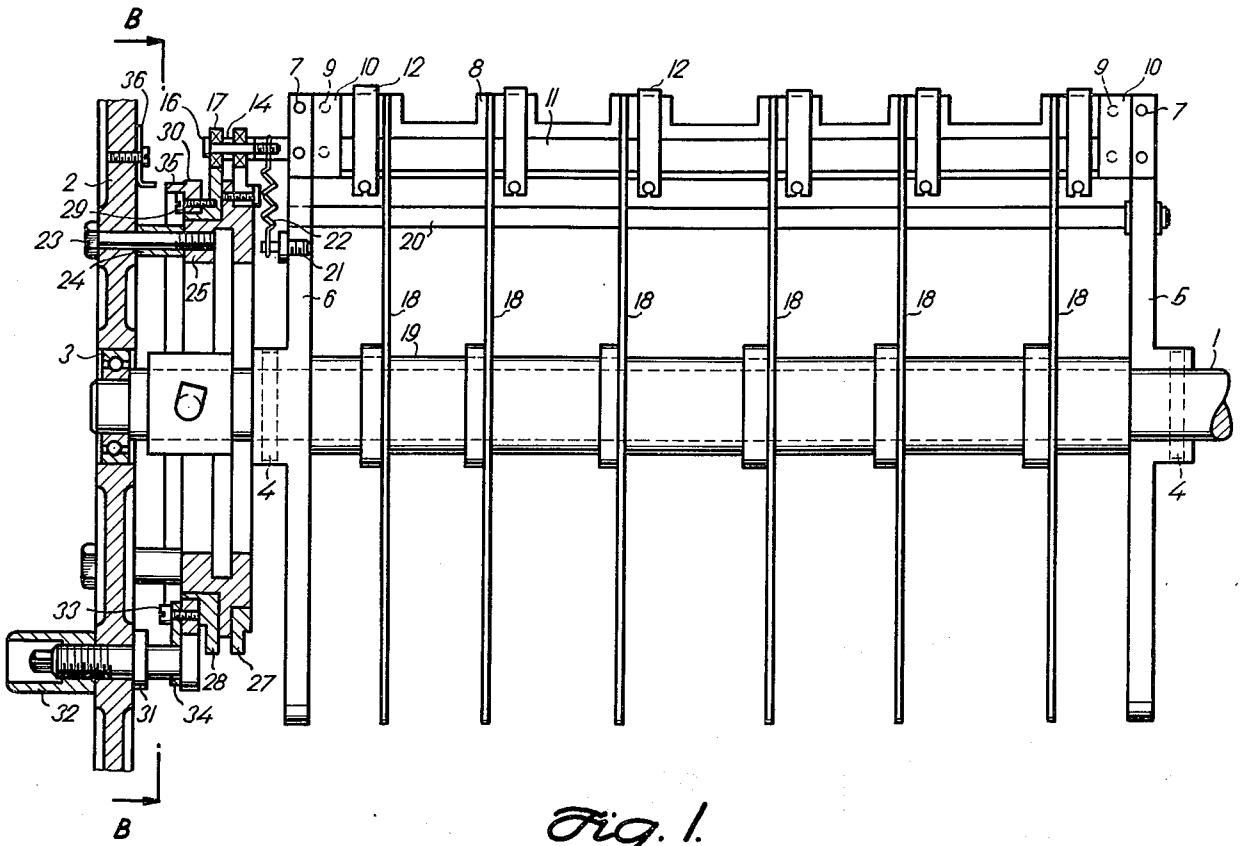
FIG. 1 is a side elevation, partly in section, of the sheet transfer cylinder and the gripping mechanism of the present invention shown in FIG. 2 and viewed along the plane A—A of FIG. 2.

Referring to the drawings there will be seen shaft 1 rotatably mounted at one end in journal bearing 3, in side wall 2 of the printing machine. The mounting of the other end of shaft 1 is not illustrated but is conventional. The transfer cylinder is journalled between the print cylinders of a pair of serially aligned printing units and is adapted to receive and move the sheet from one to the other. The transfer cylinder is rotated by connection in conventional manner with either the main drive means or one or the other of the associated printing units. Suitable drive, motor and gear transmission means are provided as is well known.

The shaft 1 is fixedly connected to opposed carrier shoulders 5, 6 by means such as pins 4. The carrier shoulders 5,6 are affixed, by means such as screws 7, to transverse bars 8 which form the surface of sheet transfer cylinder. Holders 10 are mounted on both ends of the bar 8 by means such as screws 9. In the holders 10 there is rotatably mounted a shaft 11 upon which are fixedly mounted grippers 12. One end of the shaft 11 carries a lever 14 which may be secured by means such as screws 13. Lever 14 is provided with a stud 16 which in turn mounts two axially spaced rollers 17. The carrier shoulders 5,6 are also connected by means of transverse rods 20 to a plurality of supporting arcuate segments 18 which are pivotally carried by tube 19.

Carrier shoulder 6 is provided with stud 21 upon which is attached one end of a spring 22. The other end of the spring is secured to a stud 16 biasing the roller 17 radially inward. A centering ring 25 is mounted between the wall 2 and the shoulder 6 about the axis of the sheet transfer cylinder defined by shaft 1, by means such as screws 23 and a spacer tube 24. Adjacent the periphery of the centering ring 25 and on the inner face thereof, there is fixedly mounted a circular segment 27. In a recess or slot on the opposite face of the centering ring 25 there is adjustably mounted a circular segment 28. The circular segments 28 and 27 have peripheral contoured edges which form surfaces on which the rollers 17 ride during selected portions of the rotation of the transfer cylinder. By adjustment of the ring 28 or the ring 25 the contoured working edge may be selectively positioned to vary engagement with the rollers 17. When the roller 17 engages the segment 28 the grippers are caused to close on the bar 8 and seize the leading edge of the sheet. The working edge of segments 27 and 28 are circular in arc so that a uniform constant actuation of the gripper 12 is affected.

Figure 2:
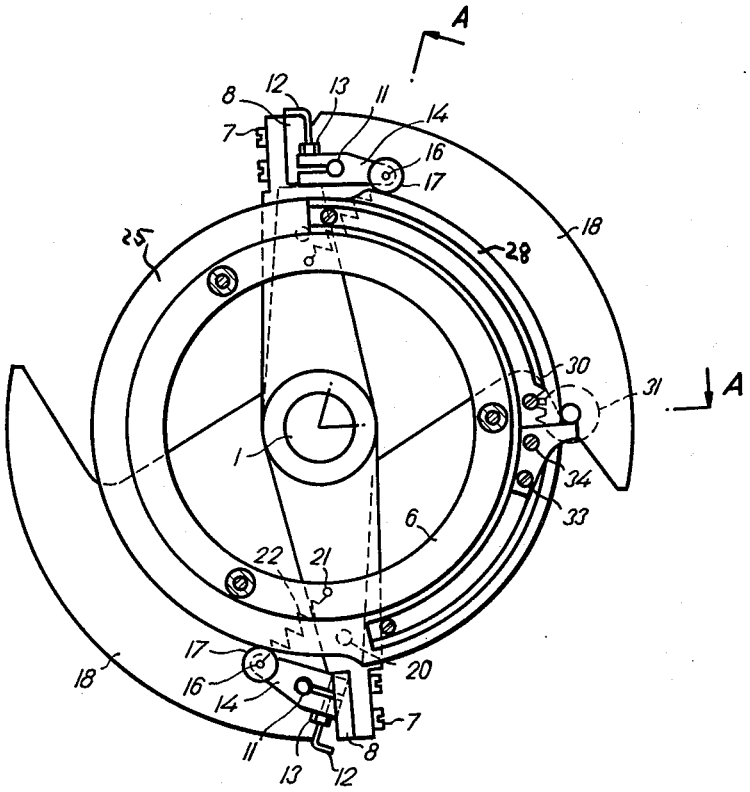
FIG. 2 is an end view of the cylinder and gripping mechanism along the plane B—B of FIG. 1.

The circular segment 28 is adjusted by having secured thereto by means such as screws 29, an annular gear segment 30 which is adapted to engage with a pinion 31 rotatably mounted in the side wall 2 of the printing machine. In order to prevent accidental turning of the pinion 31 it is secured by means of a nut 32. On the circular segment 28 in the vicinity of toothed gear segment 30, there is fixed by means such as screws 33 an adjustable stop 34. The stop 34 bears against the pinion 31, that is against the hub of the pinion as seen in FIGS. 1 and 2. On the circumference of the toothed segment 30 there is provided a scale 35 opposite to which a pointer 36 is attached to the side walls 2 of the printing machine.

For transfer of sheet between two printing units for printing on the same side, the sheet transfer cylinder is rotated in the usual manner. As this is done the grippers 12 are actuated by movement of rollers 17 over the circular segments 27 and 28, such movement being translated to the grippers through lever 14 by stud 16 against the bias of springs 22. The paper sheets are then gripped between the grippers 12 and the edge of the transverse bar 8 and transferred. While transferring the paper sheet the stop 34 bears on the hub of pinion 31 as noted above. When the printing machine is to be adjusted from printing of one side of a paper sheet to the printing on both sides of the sheet by operating the cylinder in the known manner therefor, the adjustable circular segment 28 is rotated relative to ring 25 about the shaft axis 1 according to the length of the paper sheet to be printed. The necessary adjustment of the circular segment 28 is carried out by loosening the nut 32 and by turning the pinion 31. This rotates the gear segment 30 to which the segment 28 is fixed. Rotation of the segment 28 varies its active or working edge relative to that of the segment 27, thus varying the position at which the paper sheet is seized during rotation of the cylinder. The degree of rotation can be visually observed by the pointer 36 and scale 35. The paper rests with its edge seized between grippers 12 and bar 8 on the arcuate support segment 18. Two sets of grippers 12, bars 8, and arcuate support segments are provided along with the other associated elements, so that on a transfer cylinder of twice the diameter of the impression or other cylinders, two sheets can be transferred during one rotation of the transfer cylinder.

A simple adjustment of the cam segment 28 permits a change from printing on one side of the sheet to printing on both sides of the sheet in accordance with the following explanation. When the sheet is printed only on one side, the leading edge of the sheet is seized by the grippers of a succeeding transfer cylinder (not illustrated). When the paper is to be printed on both sides (perfecting printing), that is to be understood to mean on one side on the first printing unit and, after transfer and turning, the same sheet is printed on the reverse side on the succeeding printing unit, the above mentioned leading edge of the sheet has to be carried by the grippers 12 for a distance which is equal to the length of the sheet to be printed in order that the trailing edge thereof can be seized by grippers of the succeeding (not illustrated) cylinder. This is made possible by the adjustment of the circular segment 28. By the turning of the circular segment 28 about the axis of shaft 1 there is achieved an elongation of the cam surfaces on which rollers 17 move and which control the opening and closing of the grippers 12.

In further explanation of the operation of the device according to the invention, the following explanation is set forth. The sheet transfer cylinder, consisting of shaft 19, of supporting arcuate segments 18 and of bars 8, has double the diameter of the adjacent transfer cylinders (not illustrated) and with which the illustrated sheet transfer cylinder cooperates.

When the transfer cylinder rotates, the rollers 17 move on the circumferential surface of the circular segments 27 and 28. As soon as the left-hand roller 17 arrives on the deepened (relieved) part of the surface of the circular segment 28, the spring 22 effects a turning of the whole gripper mechanism and the grippers 12 are lifted from the abutment bar 8, as may be seen on the bottom of FIG. 2. With regard to the fact that the overtaking of the sheet by the succeeding cylinder must be carried out in a point on the line connecting the centers of the adjacent transfer cylinders, it is necessary that the circular segments 27 and 28 be adjustable relative to each other. For this purpose the circular segment 27 is fixed on the centering ring 25 in such a way that the beginning of the higher part of the functional surface of the segment will act to close the grippers 12 at a point on the line connecting the center of the transfer cylinder with the center of the preceding and adjacent (not illustrated) transfer cylinder.

The opening of the grippers at the moment of handing over of the paper sheet to the succeeding transfer cylinder (not illustrated) of the second printing unit is effected in a manner so that the roller 17 moves on the end of the higher circumferential part of the circular segment 28. The circular segment 28 is mounted turnably on the centering ring 25. This enables the proper positioning of the circular segment 28 to effect the opening of the grippers 12, the reaching of which position is defined by the adjustable stop 34 fixed on the circular segment 28, when the arm of this stop 34 seats (bears) on the hub of the pinion 31. In this way, the relative position of the circular segments 27 and 28 is determined. The adjustable stop 34 coacts with the hub of the pinion 31 only when the sheet transfer mechanism is adjusted for the printing on one side of the sheet. When the mechanism is to be adjusted for printing on both sides of the sheet (perfecting printing), it is necessary to loosen the nut 32 and then the circular segment 28 by means of the pinion 31 to bring the device into position where the scale 35 provided on the circular segment 28 shows in relation to the indicator 36 the length to which it is to be adjusted and which is equal to the length of the paper sheet to be printed.

In this adjustment of the device for printing on both sides of the sheet, where the sheet has to be turned for this purpose, the circular segment 28 with the step 34 is rotated about the shaft axis 1 in such a fashion, that the stop 34 is carried away from the hub of the pinion 31, so that it is not in engagement while the operation of sheet turning takes place.

By such adjustment a prolongation or increase of the higher functional surfaces of the circular segments 27 and 28 is achieved, this prolongation being equal to the length of the sheet to be printed.

Various modifications and embodiments will of course be evident to those skilled in this art. Accordingly, the foregoing disclosure is to be taken as illustrative only, and not limiting of the scope of the present invention.

What is claimed is:

1. A sheet transfer apparatus for a rotary printing machine capable of successive printing selectively on one or both sides of a sheet, comprising a transfer cylinder mounted between the side walls of said machine for rotation about its central axis and being provided adjacent the surface thereof with a fixed transverse bar and with a rotatable shaft spaced therefrom, gripping means secured to said shaft in opposition to said bar, said bar and said gripping means adapted to receive the edge of a sheet therebetween, and means for selectively actuating said shaft to cause said gripping means to engage said transverse bar and hold said sheets during rotation of said cylinder, comprising a fixed centering ring mounted between said transfer cylinder and one side wall coaxially with the axis of rotation of said transfer cylinder, said centering ring having a pair of circular segments secured to opposed peripheral faces of said centering ring adjacent each other, said segments having radially extending circular cam surfaces, roller means carried at one end of said shaft adjacent said centering ring for engaging the cam surfaces of each of said circular segments, means for biasing said roller means to engage with said cam surfaces, said engagement causing said gripping means to be activated into engagement with said transverse bar, the first of said segments being fixed with respect to said centering ring and the second of said segments being circumferentially adjustable with respect to said first of said segments to vary the length of engagement of said rollers with said cams whereby the point at which said grippers are free from engagement with said transverse bar is adjustable relative to the degree of rotation of said transfer cylinder.

2. A sheet transfer cylinder according to claim 1, wherein a pinion is rotatably mounted on said one side wall, said second circular segment is provided with a toothed portion, and said pinion is adapted to engage with said toothed portion to provide said circumferential adjustment of said second segment, said toothed portion being provided with adjustable stop means for limitation of the travel of said second circular segment.

3. A sheet transfer cylinder according to claim 2, wherein a scale and pointer are mounted on said toothed portion and said one side wall to provide indicia for regulation of the degree of circumferential adjustment of said second segment.

4. A sheet transfer cylinder according to claim 1, wherein said one end of said shaft is provided with a lever and said lever mounts a pair of said rollers.

* * * * *